US005641278A

United States Patent [19]

Tsumagari et al.

[11] Patent Number: 5,641,278

[45] Date of Patent: Jun. 24, 1997

[54] SCROLL COMPRESSOR

[75] Inventors: Yuichi Tsumagari, Toyokawa; Shinya Yamamoto; Tetsuhiko Fukanuma, both of Kariya, all of Japan

[73] Assignees: Nippondenso Co., Ltd.; Kabushiki Kaisha Tiyoda Jidoshokki, both of Kariya, Japan

[21] Appl. No.: 439,217

[22] Filed: May 11, 1995

[30] Foreign Application Priority Data

May 12, 1994 [JP] Japan ..... 6-098949

[51] Int. Cl.[6] ..... F01C 1/04

[52] U.S. Cl. ..... 418/55.2; 418/55.1

[58] Field of Search ..... 418/55.1, 55.2, 418/55.4

[56] References Cited

U.S. PATENT DOCUMENTS 4,522,574 6/1985 Arai et al. ..... 418/55.1

4,674,963 6/1987 Morishita et al. ..... 418/55.1

FOREIGN PATENT DOCUMENTS 57-28890 2/1982 Japan ..... 418/55.2

59-28091 2/1984 Japan ..... 418/55.1

60-204991 10/1985 Japan ..... 418/55.2

341187 4/1991 Japan .

82206013 12/1993 Taiwan .

*Primary Examiner*—Charles G. Freay

*Attorney, Agent, or Firm*—Cushman, Darby & Cushman IP Group of Pillsbury Madison & Sutro LLP

[57] ABSTRACT

A scroll compressor, having a stationary scroll member, wherein machining of the scroll wall, as well as measurement of the length are easy, and an adjustment of an axial clearance is also easy. The contact surface between an outer wall 8 of the stationary scroll member 5 and a front housing 3 is located on a different plane as that of an end surface 7*a* of the scroll wall 7 of the stationary scroll member 5.

1 Claim, 2 Drawing Sheets

SCROLL COMPRESSOR

BACKGROUND OF THE INVENTION

1. Field of the Invention

The present invention relates to a scroll compressor used, for example, as a refrigerant compressor in an air conditioning apparatus for an automobile.

2. Description of Related Art

A scroll compressor having a stationary and a movable scroll member arranged in a housing (is disclaimed in Japanese Un-Examined Utility Model Publication No. 3-41187. The stationary and the movable scroll member each has a scroll wall extending from a base plate. The scroll wall of the stationary scroll member functions also as a central housing and faces the base plate of the movable scroll member, while the scroll wall of the movable scroll member, arranged movably in the front housing, faces the base plate of the stationary scroll member. In order to obtain a desired compression operation, the precision of the axial clearance between these parts is important. In the prior art, the central housing has a portion, extending from the end surface of the scroll wall of the stationary scroll member, which makes machining as well as a dimensional measurement of the scroll wall difficult. Furthermore, in the prior art construction, the adjustment of an axial clearance of the compressor is complicated due to an increased number of axial dimensions to be controlled. Furthermore, the prior art construction is defective in that foreign particles may be caught between the stationary scroll member and movable scroll member, causing the members to be damaged. Finally, in the prior art construction, the center housing is likely to be deformed due to its increased axial length.

SUMMARY OF THE INVENTION

An object of the present invention is to provide a scroll compressor, wherein machining as well as dimensional measurement are easy, while the adjustment of an axial clearance is simplified.

Another object of the present invention is to provide a scroll compressor, capable preventing the housing from being damaged by foreign particles in the compressor.

Still another object of the present invention is to provide a scroll compressor, capable of preventing the housing from being easily deformed.

According to the present invention, a scroll compressor is provided, comprising:

a housing assembly having first and second housings, which are separate from each other and which cooperate with each other to create therein a chamber of a substantially cylindrical shape;

a stationary scroll member having a base plate and a scroll wall which extends axially and integrally from the base plate;

a movable scroll member having a base plate and a scroll wall which extends axially and integrally from the base plate;

the movable scroll member being rotatable with respect to the housing assembly;

the scroll wall of the stationary scroll member and the scroll wall of the movable scroll member being in radial contact with each other, while the scroll wall of the stationary scroll member is in axial contact with the base plate of the movable scroll member, and the scroll wall of the movable scroll member is in axial contact with the base plate of the stationary scroll member, so that a plurality of radially spaced compression chambers are formed between the stationary and the movable scroll member;

a rotating shaft which is rotatable with respect to the housing assembly and which is connected to the movable scroll member, so that the rotating movement from the rotating shaft is transmitted to the movable scroll member, and;

means for preventing the movable scroll member from rotating about its own axis, so that the compression chambers are displaced radially from an outward position for introduction of gas to be compressed to an inward position for discharge of the compressed gas;

the first housing having a cylindrical outer wall which is integrally connected to the base plate of the stationary scroll member;

the second housing having a cylindrical outer wall;

the cylindrical outer wall of the first housing and the cylindrical outer wall of the second housing having axially facing end surfaces extending transversely to an axis of the rotating shaft and which are in an axial contact with each other;

the axially contacting end surfaces being located on a plane which is axially rearwardly spaced from the scroll wall of the stationary scroll member toward the base plate thereof such that the cylindrical outer wall of the second housing cooperates with the cylindrical outer wall of the first housing to form an outermost portion of the stationary scroll member.

BRIEF DESCRIPTION OF ATTACHED DRAWINGS

DETAILED DESCRIPTION OF THE PREFERRED EMBODIMENT

Figure 1:
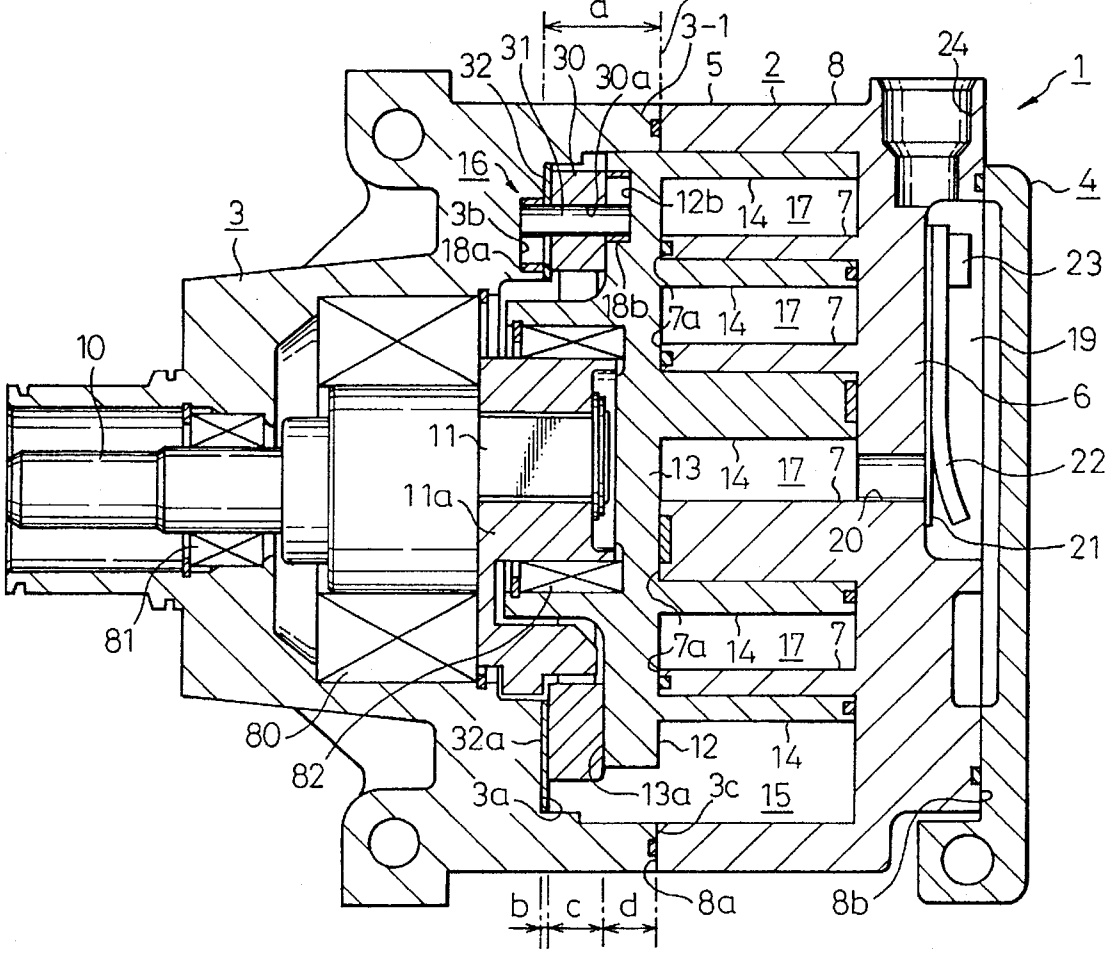
FIG. 1 is a longitudinal cross sectional view of a scroll compressor according to the present invention.

A first embodiment of the present invention will now be explained with reference to FIG. 1. Namely, in FIG. 1, a scroll compressor is provided with a housing 1 which includes a center housing 2, a front housing 3 (front housing), and a third housing (rear housing 4). The center housing 2 includes, as a one piece member, a stationary scroll member 5 which includes a base plate 6, a scroll wall 7 extending axially from the base plate 6, and an outer cylindrical wall 8 which is located radially outwardly with respect to the scroll wall 7. The cylindrical outer wall 8 has an end surface **8*a* which extends transverse to the axis of a rotating shaft 10. The front housing 3 has an end surface 3*c* which also extends transversely to the axis of the rotating shaft 10 and which is in face-to-face contact with the end surface 8*a* of the outer cylindrical wall 8. The front housing 3 has an outer cylindrical part 3-1, which is in face to face contact with the outer cylindrical wall 8, and connected to the outer cylindrical wall 8 by means of circumferentially spaced sets of bolts and nuts (not shown). As shown in FIG. 1, the face-to-face contact surfaces 8*a* and 3*c* between the center housing 2 and the front housing 3 are located on a plane L, which is transverse to the axis of the shaft 10, and on which an end surface 7*a* of the scroll wall 7 of the stationary scroll member 5** is located.

The rotating shaft 10 is rotatably supported on the front housing 3 by means of a radial bearing 80. Adjacent to the bearing 80, a shaft seal unit 81 is arranged between the housing 3 and the shaft 10. An accentric shaft 11 of a rectangular cross-sectional shape extends integrally from the shaft 10 at a location spaced from the axis of the shaft 10. The eccentric shaft 11 is axially slidably inserted to a bushing 11*a* and a rotating movement from the eccentric shaft 11 is transmitted to the bushing 11*a*. A movable scroll member 12 is rotatably supported on the bushing 11*a* via a second radial bearing unit 82. The movable scroll member 12 is formed with a base plate 13 and a scroll wall 14 extending integrally from the base plate 13. The scroll walls 7 and 14 of the scroll members 5 and 12 are in radial contact at at least two points. Furthermore, the scroll wall 7 of the stationary scroll member 5 is in axial contact with the base plate 13 of the movable scroll member 12, while the scroll wall 14 of the movable scroll member 12 is in axial contact with the base plate 6 of the stationary scroll member 5. As a result, compression chambers 17 are formed between the stationary scroll member 5 and the movable scroll member 12. The compression chambers 17 are moved radially inwardly while their volumes are reduced during an orbital movement of the movable scroll member 12 about an axis of the rotating shaft 10. An intake chamber 15 is formed inside the housing at a location between the outer cylinder 8 and the outer surface of the movable scroll member 12, which is opened to an intake port (not shown), which is in communication with a source of a gaseous refrigerant, such as an evaporator in a refrigerating circuit, so that the gas is introduced into the intake chamber 15. An orbital movement of the movable scroll member 13 causes the intake chamber 15 to be outwardly sealed in order to create a compression chamber 17, which allows the gas therein to be compressed.

A self-rotation blocking mechanism is arranged between the base plate 13 of the movable scroll member 12 and the front housing 3, so that an orbital movement of the movable scroll member 12 about the axis of the shaft 10 is obtained, while preventing the scroll member 12 from being rotated about its own axis. The construction of the self-rotation blocking mechanism will, now, be explained. Namely, the front housing 3 is, at an end wall 3*a* faced with the movable scroll member 12, formed with a plurality of circumferentially spaced circular recess 3*b*, to which metal sleeves 18*a* are respectively press fitted. Similarly, the base plate 13 of the movable scroll member 12 is, at its rear wall faced with the front housing 3, formed with a plurality of circumferentially spaced circular recess 12*b*, to which metal sleeves 18*b* are respectively press fitted. The recess 3*b* and 12*b* form circumferentially spaced opposite pairs. A ring shaped retainer 30 is arranged between the front housing 3 and the movable scroll member 12, and is formed with a plurality of circumferentially spaced holes 30*a*. Pins 31 are fitted to the holes 30*a*, respectively, so that their opposite ends project out of axial end surfaces of the ring 30. The ends of the pins 31 are engaged with the sleeves 18*a* and 18*b*, respectively, of the corresponding pair of the recess 3*b* and 12*b*. An arrangement of the pins 31 allows the movable scroll member 12 to be supported radially at circumferentially spaced positions of the housing. As a result, the orbital movement of the movable scroll member 12 is obtained, while the movable scroll member 12 is prevented from being rotated about its own axis. A ring shaped plate 32 is fixedly connected to a surface (compression pressure receiving surface) of an inner wall 3*a* of the front housing 3. The plate 32 functions to receive a compression reaction force generated on the movable scroll member 12.

The rear housing 4 is connected to a rear end of the stationary scroll member 5 by means of sets of bolts and nuts (not shown), so that a high pressure chamber 19 is formed between the base plate 6 of the stationary scroll member 5 and the rear housing 4. An outlet port 20 is formed in the base plate 6 therethrough, so that the high pressure chamber 19 is in communication with a compression chamber 17, when the latter is in a radially inner position, thereby discharging the compressed gas in the chamber 17 into the high pressure chamber 19 via a reed valve 21. The reed valve 21 together with a stopper plate 22 are fixedly connected to the base plate 6 by means of a bolt 23.

The rotating movement of the shaft 10 causes the eccentric shaft 11 to be rotated about the axis of the shaft 10, so that an orbital movement of the movable scroll member 12 about the axis of the shaft 10 is obtained, while the movable scroll member 12 is prevented from being rotated about its own axis. During the orbital movement of the movable scroll member 12, the refrigerant gas is, first, sucked into the intake chamber 15. The intake chamber 15 is, then, sealed as a compression chamber 17, and is radially inwardly moved, while its volume is reduced, thereby compressing the gas. The compression chamber 17 is, finally, opened to the outlet port 20, so that the compressed gas is discharged into the high pressure chamber 19, via the reed valve 21.

In the construction of the scroll compressor according to the present invention, the axial end surfaces 7*a* and 8*a* of the scroll wall 7 and the outer cylindrical wall 8, respectively, of the stationary scroll member 5 are located on one and the same plane L, which is transverse to the axis of the shaft 10. As a result, the machining of the end surfaces 7*a* and 8*a* by means of a tool such as a milling tool or a grinding tool can be done simultaneously. Thus, productivity during the machining operation can be increased. Contrary to this, in the prior art in Japanese Un-Examined Utility Model Publication No. 3-41187, an axial end surface of the outer cylindrical wall of the stationary scroll member is axially inwardly spaced from an outer end surface of a scroll wall and, as a result, machining, as well as dimensional measurement, becomes difficult.

In the present invention in FIG. 1, the axial clearance is determined by:

(1) an axial length a between the connection plane L and an end (pressure receiving) surface 3*a* of the housing 3;

(2) an axial thickness b of the plate 32;

(3) an axial thickness c of the ring shaped retainer 30, and;

(4) an axial thickness d of the base plate 13 of the movable scroll member 12. Namely, the values of these axial dimensions a, b, c and d must be such that a desired axial clearance is obtained. In other words, the machining as well as the dimensional measurement of the parts are sufficient if the values of these four axial dimensions are maintained in respective desired ranges. Thus, the efficiency of working during the machining and the dimensional measurement can be increased. Contrary to this, in the prior art in Japanese Un-Examined Utility Model Publication No. 3-41187, the axial end surface of the outer cylindrical wall of the stationary scroll member is spaced from the end surface of a scroll wall. As a result, in order to obtain the desired axial clearance, the number of the dimensions to be controlled is increased, thereby reducing the working efficiency during the machining and the dimensional measurement.

In the construction of the present invention shown in FIG. 1, the outer cylindrical wall 8 of the stationary scroll member 5 has the axial end surface 8*a*, which is located on one and the same plane of the axial and surface 7*a* of the scroll wall 7 of the scroll member 5. In other words, the cylindrical wall 8 of the center housing 2 terminates at a location axially spaced from the surface 13*a* of the base plate 13 of the movable scroll member 12 opposite the scroll wall 14. As a result, any foreign substances generated in the compressor is not caught between the faced circumferential walls of the stationary and movable scroll members, thereby preventing the scroll members from being damaged. Furthermore, the cylindrical wall 8 can be more independent with respect to the deformation of the stationary scroll member, which may occur during the assembly of the compressor or during the operation of the scroll compressor. Contrary to this, in the prior art in Japanese Un-Examined Utility Model Publication No. 3-41187, a connection plane between the front and central housings is located on an axial end surface of a base plate of a movable scroll member spaced from its scroll wall. As a result, there is a possibility that foreign particles generated in the scroll are caught between the faced circumferential surfaces of the stationary and movable scroll members, thereby damaging the scroll members.

In the construction according to the present invention in FIG. 1, and axial length of the cylindrical wall 8 is reduced, which can reduce a moment, generated in the cylindrical wall 8, by the tightening force on the bolts for connecting the center housing 2 and front housing 3, thereby reducing the deformation of the wall 8. As a result, an error in an axial dimension of the part can be reduced, thereby preventing the compression efficiency from being reduced. Contrary to this, in the prior art in Japanese Un-Examined Utility Model Publication No. 3-41187, the length of the outer cylindrical wall is increased, so that the wall may be deformed by the force generated when the scroll compressor is assembled or when a high load is applied to the compressor. Such a deformation of the outer cylindrical wall causes the axial clearance to be different from a desired value, thereby making it difficult to obtain a desired compression operation.

Figure 2:
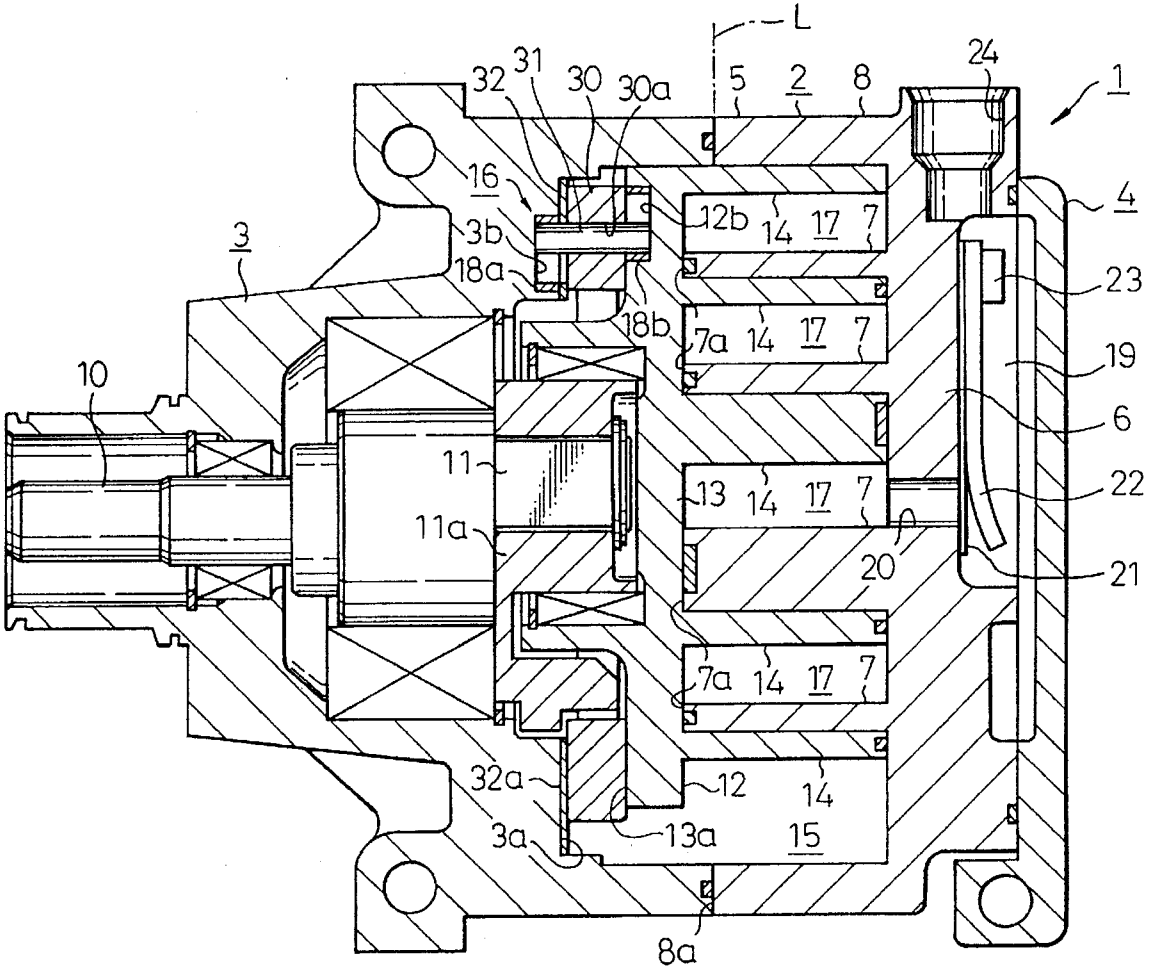
FIG. 2 shows a modification of a scroll compressor according to the present invention.

FIG. 2 shows a second embodiment of the present invention, where the cylindrical outer wall 8 of the center housing 2 axially terminates so that the end surface 8*a* is spaced inwardly from the end surface 7*a* of the scroll wall 7. In this case, unlike in the first embodiment in FIG. 1, the machining of the end surfaces 7*a* and 8*a* cannot be done simultaneously. However, the advantage of a further reduction in the axial length of the wall 8 is obtained, thereby increasing the mechanical strength of the compressor.

We claim:

1. A scroll compressor comprising:

a housing assembly having first and second housings separate from each other and cooperating with each other to create therein a chamber of a substantially cylindrical shape;

a stationary scroll member having a base plate and a scroll wall which extends axially and integrally from the base plate;

a movable scroll member having a base plate and a scroll wall which extends axially and integrally from the base plate;

the movable scroll member being rotatable with respect to the housing assembly;

the scroll wall of the stationary scroll member and the scroll wall of the movable scroll member being in radial contact with each other while the scroll wall of the stationary scroll member is in axial contact with the base plate of the movable scroll member and the scroll wall of the movable scroll member is in axial contact with the base plate of the stationary scroll member so that a plurality of radially spaced compression chambers are formed between the stationary and movable scroll members;

a rotating shaft which is rotatable with respect to the housing assembly and which is connected to the movable scroll member, so that a rotating movement from the rotating shaft is transmitted to the movable scroll member; and means for preventing the movable scroll member from rotating about its own axis so that the compression chambers are displaced radially from an outward position for introduction of gas to be compressed to an inward position for discharge of the compressed gas;

the first housing having a cylindrical outer wall which is integrally connected to the base plate of the stationary scroll member;

the second housing having a cylindrical outer wall;

the cylindrical outer wall of the first housing and the cylindrical outer wall of the second housing having axially faced end surfaces which extend transversely to an axis of the rotating shaft and are in an axial contact with each other;

the axially contacting end surfaces being located on a plane which is axially spaced from an end surface of the scroll wall of the stationary scroll member toward the base plate thereof such that the cylindrical outer wall of the second housing cooperates with the cylindrical outer wall of the first housing to form an outermost portion of the stationary scroll member.

* * * * *